US012044434B2

(12) United States Patent
Chothave et al.

(10) Patent No.: US 12,044,434 B2
(45) Date of Patent: Jul. 23, 2024

(54) BASE PAN ASSEMBLY

(71) Applicant: Johnson Controls Tyco IP Holdings LLP, Milwaukee, WI (US)

(72) Inventors: Amit R. Chothave, Pimri Chinchwad (IN); Piyush R. Adhav, Ahmednagar (IN); Sriram Ramanujam, Chennai (IN)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 150 days.

(21) Appl. No.: 17/464,495

(22) Filed: Sep. 1, 2021

(65) Prior Publication Data

US 2022/0065493 A1 Mar. 3, 2022

(30) Foreign Application Priority Data

Sep. 1, 2020 (IN) ..... 202011037688

(51) Int. Cl.
*F24F 13/22* (2006.01)
*F24F 13/20* (2006.01)

(52) U.S. Cl.
CPC ..... *F24F 13/222* (2013.01); *F24F 13/20* (2013.01)

(58) Field of Classification Search
CPC .. F24F 13/222; F24F 13/20; F24F 1/36; F24F 13/32
USPC ..... 62/291
See application file for complete search history.

(56) References Cited

U.S. PATENT DOCUMENTS

RE13,679 E * 1/1914 Keyes ..... 62/189
1,872,728 A * 8/1932 Gloekler ..... A47F 3/0417 62/286
1,899,980 A * 3/1933 O'Connor ..... B61D 27/0081 62/291
2,210,725 A * 8/1940 MacMaster ..... A47F 3/0417 62/286
2,750,759 A * 6/1956 Harle ..... F25D 21/14 62/286
2,764,875 A * 10/1956 Beckett ..... F25D 11/022 62/289
2,797,553 A * 7/1957 Baillif ..... F25D 21/14 62/454
2,886,956 A * 5/1959 Loveley ..... F24D 5/00 165/48.1
3,102,654 A * 9/1963 Millman ..... F24F 13/22 16/221

(Continued)

FOREIGN PATENT DOCUMENTS

JP 2009287793 A * 12/2009

OTHER PUBLICATIONS

JP 2009287793 A—machine translation (Year: 2023).*

*Primary Examiner* — Eric S Ruppert
*Assistant Examiner* — Kirstin U Oswald
(74) *Attorney, Agent, or Firm* — Fletcher Yoder, P.C.

(57) ABSTRACT

Embodiments of the present disclosure are directed to a base pan assembly configured to couple to a base of an enclosure of a heating, ventilation, and air conditioning (HVAC) system, where the base pan assembly includes a base pan including a main body having a slope extending from an inner portion of the main body to an outer edge of the main body and an elevation system coupled to the base pan, where the elevation system actuatable to adjust the slope of the main body.

20 Claims, 10 Drawing Sheets

(56) References Cited

U.S. PATENT DOCUMENTS

| | | | | | |
|---|---|---|---|---|---|
| 3,501,879 | A * | 3/1970 | Roach | A47K 3/40 | 52/302.1 |
| 3,551,918 | A * | 1/1971 | Bergmark | A47K 3/40 | 52/198 |
| 3,557,992 | A * | 1/1971 | Reeves | E04C 2/205 | 220/592.25 |
| 3,790,115 | A * | 2/1974 | Fox | F25D 23/006 | 248/346.5 |
| 4,597,269 | A * | 7/1986 | Kim | F24F 13/22 | 62/286 |
| 4,651,887 | A * | 3/1987 | Patrick | F16N 31/006 | 220/255 |
| 4,783,971 | A * | 11/1988 | Alba | F25D 21/14 | 312/334.44 |
| 5,718,351 | A * | 2/1998 | Rude | B65D 77/061 | 220/571 |
| 6,519,966 | B1 * | 2/2003 | Martin, Sr. | F24F 3/001 | 62/412 |
| 6,868,689 | B1 * | 3/2005 | McNeil | F24F 13/222 | 62/288 |
| 10,557,644 | B1 * | 2/2020 | Steele | F24F 13/222 | |
| 2008/0142525 | A1 * | 6/2008 | Brouillette | F24F 13/222 | 220/571 |
| 2014/0331698 | A1 * | 11/2014 | Daley | F24F 13/224 | 62/291 |

* cited by examiner

BASE PAN ASSEMBLY

CROSS REFERENCE TO RELATED APPLICATION

This application claims priority to and the benefit of India Provisional Application Serial No. 202011037688, entitled "A BASE PAN ASSEMBLY," filed Sep. 1, 2020, which is hereby incorporated by reference in its entirety for all purposes.

BACKGROUND

The section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. The HVAC system may have various enclosures or sections, such as an enclosure through which an air flow, such as an ambient air flow, may be directed. In some circumstances, liquid, such as outdoor precipitation, may accumulate within one of the enclosures. However, accumulation of liquid within the enclosure may not be desirable for operation or longevity of the HVAC system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and air conditioning (HVAC) system includes a base pan assembly coupled to a base of an enclosure of the HVAC system, where the base pan assembly includes a base pan including a main body having a slope extending from an inner portion of the main body to an outer edge of the main body and an elevation system coupled to the base pan, where the elevation system actuatable to adjust the slope of the main body.

In another embodiment, a heating, ventilation, and air conditioning (HVAC) system includes an enclosure configured to support at least one component of a vapor compression system, where the enclosure includes a base. The HVAC system also includes a base pan coupled to the base, where the base pan has a main body extending along a slope from an inner portion of the main body to an outer edge of the main body and an elevation system coupled to the base pan, where the elevation system is configured to engage with the base, and the elevation system is actuatable to adjust the slope.

In a further embodiment, a heating, ventilation, and air conditioning (HVAC) unit includes an enclosure having a base, a compressor disposed within the enclosure and supported by the base, a base pan disposed within the enclosure beneath the compressor, relative to gravity, and coupled to the base, an anchor coupled to the base pan, and a fastener extending through the anchor, where the fastener is configured to engage with the base and bias the base pan away from the base such that the base pan has a slope extending from the anchor to an outer edge of the base pan.

DRAWINGS

Various aspects of the present disclosure may be better understood upon reading the following detailed description and upon reference to the drawings, in which.

DETAILED DESCRIPTION

Figure 1:
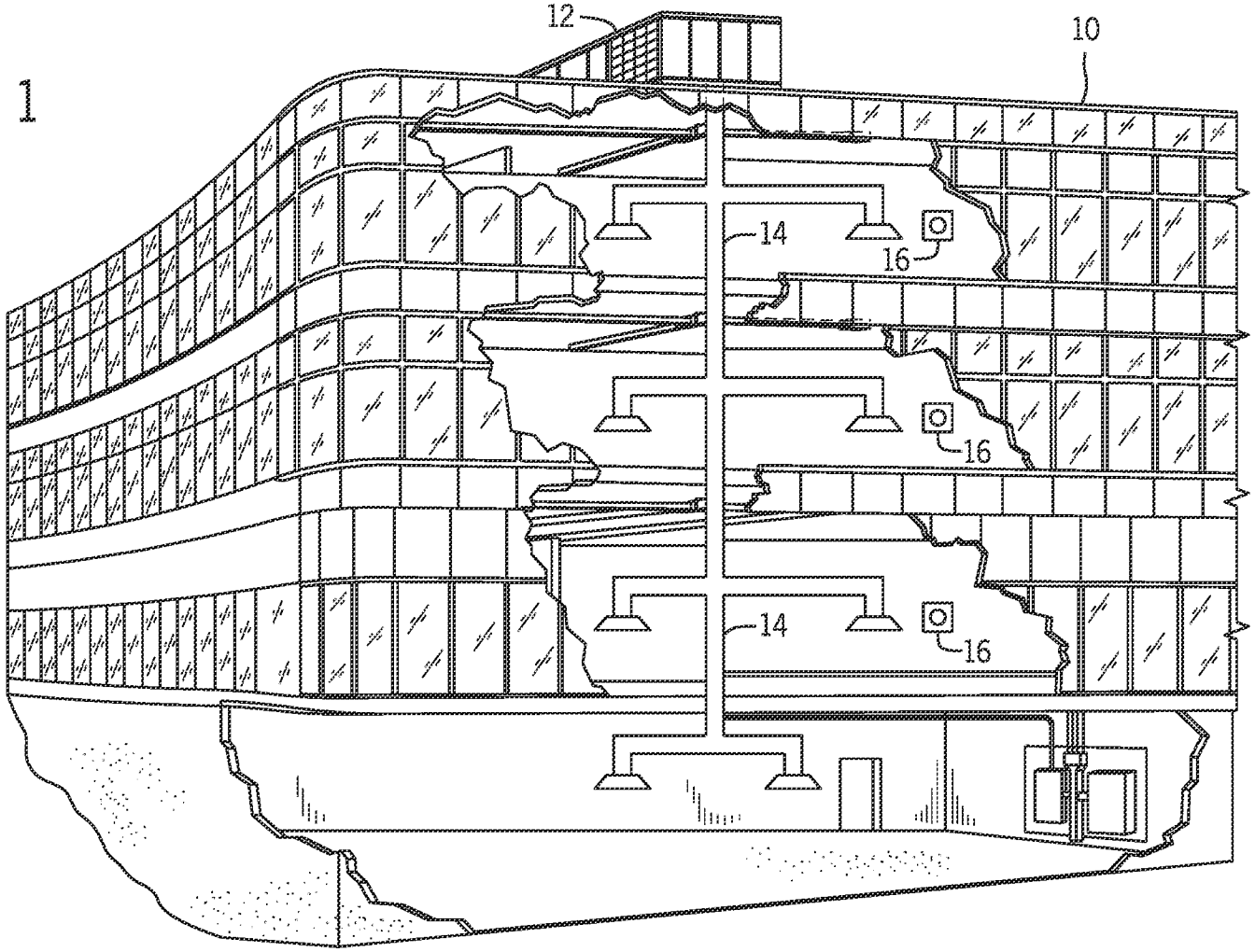
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to an HVAC system configured to condition an air flow. More particularly, the present disclosure is directed to a base pan assembly for the HVAC system. The HVAC system may include a vapor compression system configured to circulate a working fluid (e.g., a refrigerant) and place the air flow in a heat exchange relationship with the working fluid to condition the air flow. The HVAC system may include various enclosures or sections. Each enclosure may occupy a volume of space, and various equipment of the HVAC system may be disposed within the volume or space. The enclosure may also include a housing or cover, which may shield the components from external debris or elements, such as elements from a surrounding (e.g., ambient) environment.

In some circumstances, liquid may accumulate in one of the enclosures of the HVAC system. For instance, the HVAC system may include an enclosure that is positioned in an ambient environment, and precipitation may enter the enclosure. In additional or alternative circumstances, liquid (e.g., condensate) may form within the enclosure during operation of the HVAC system, such as via operation of a heat exchanger of the HVAC system. However, the accumulation of liquid in the enclosure may not be desirable. As an example, the liquid may travel within the enclosure undesirably, such as toward equipment disposed within the enclosure and/or toward a structure that is conditioned by the HVAC system. In some instances, contact between the enclosure and/or the equipment disposed therein may impact performance of the HVAC system and/or reduce a useful life of the HVAC system and/or the equipment disposed therein. Furthermore, the liquid may affect a condition of the enclosure, such as by increasing a weight of the enclosure.

Thus, it is presently recognized that directing or guiding the liquid out of the enclosure may improve the operation of the HVAC system and/or the condition of the HVAC system (e.g., the enclosure and/or the equipment disposed therein). Accordingly, embodiments of the present disclosure are directed to an improved base pan assembly that may be implemented with the enclosure. In an installed configuration, a base pan (e.g., sloped base pan) of the base pan assembly may be downwardly sloped to direct liquid across the base pan. Furthermore, the downward slope may extend from an interior of the enclosure to an outer edge of the enclosure, such that the base pan directs the liquid toward the outer edge, off the base pan, and out of the enclosure. As such, the base pan assembly disclosed herein limits accumulation of liquid within the enclosure. Moreover, in accordance with the techniques described below, the disclosed base pan assembly facilitates improved and simplified manufacture of the base pan assembly and installation the base pan assembly within the HVAC system. For example, the base pan assembly may be manufactured cost effectively, such as without the use of specialized tools or processes and may be installed with increased ease and adjustability. As a result, the presently disclosed techniques enable a reduction in costs associated with manufacture and installation of the HVAC system, as well as improved operation of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
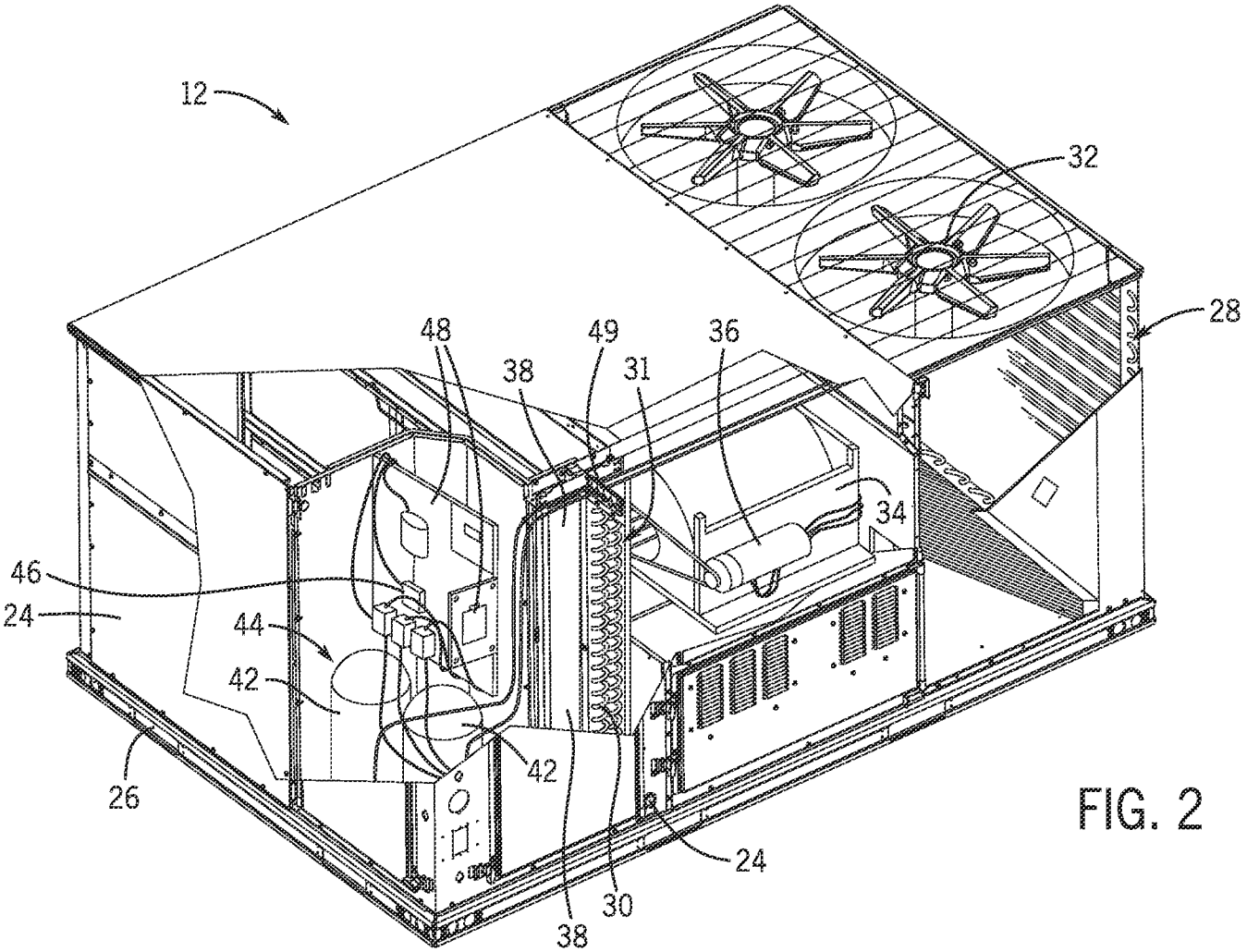
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
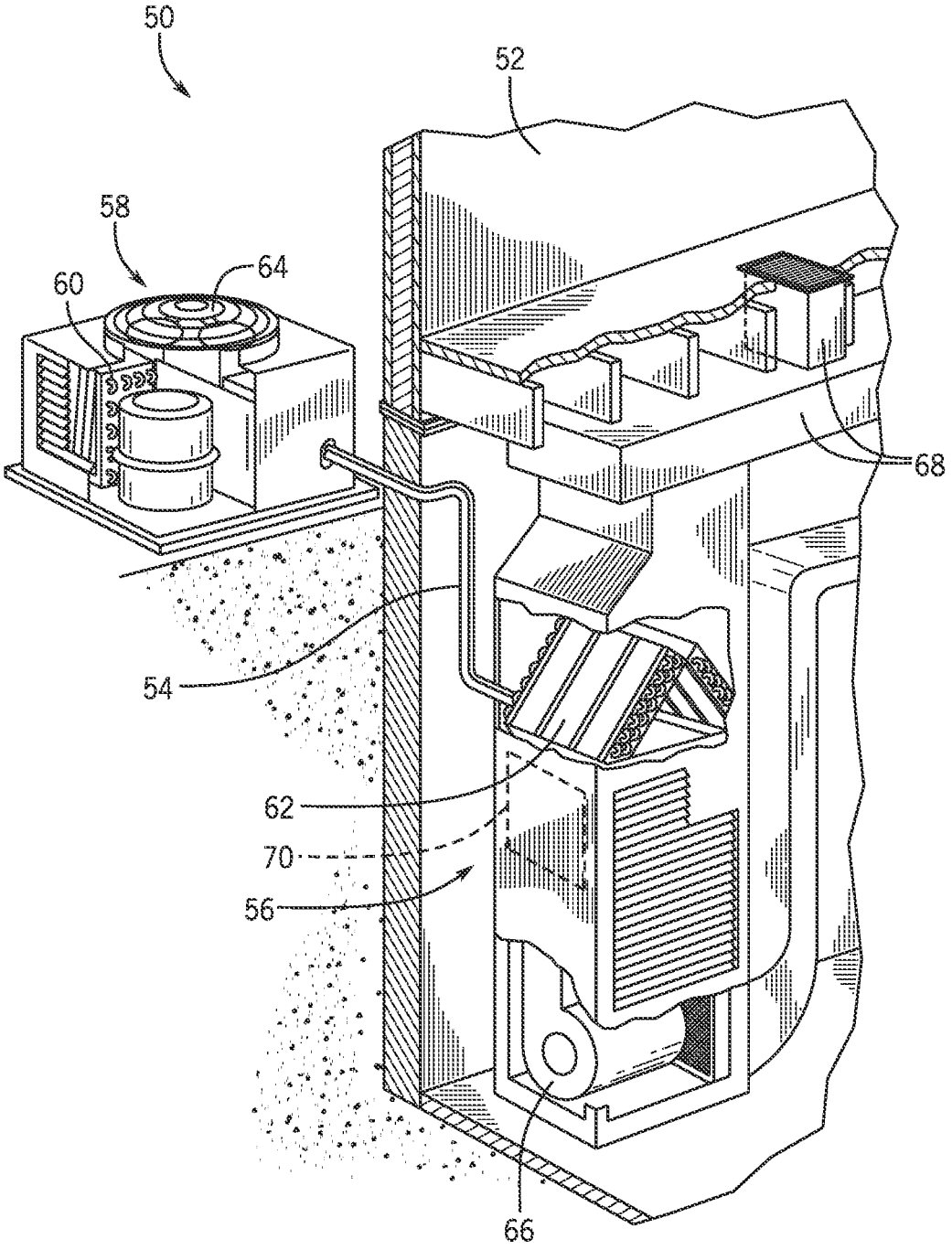
FIG. 3 is a perspective view of an embodiment of a split, residential HVAC system, in accordance with an embodiment of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
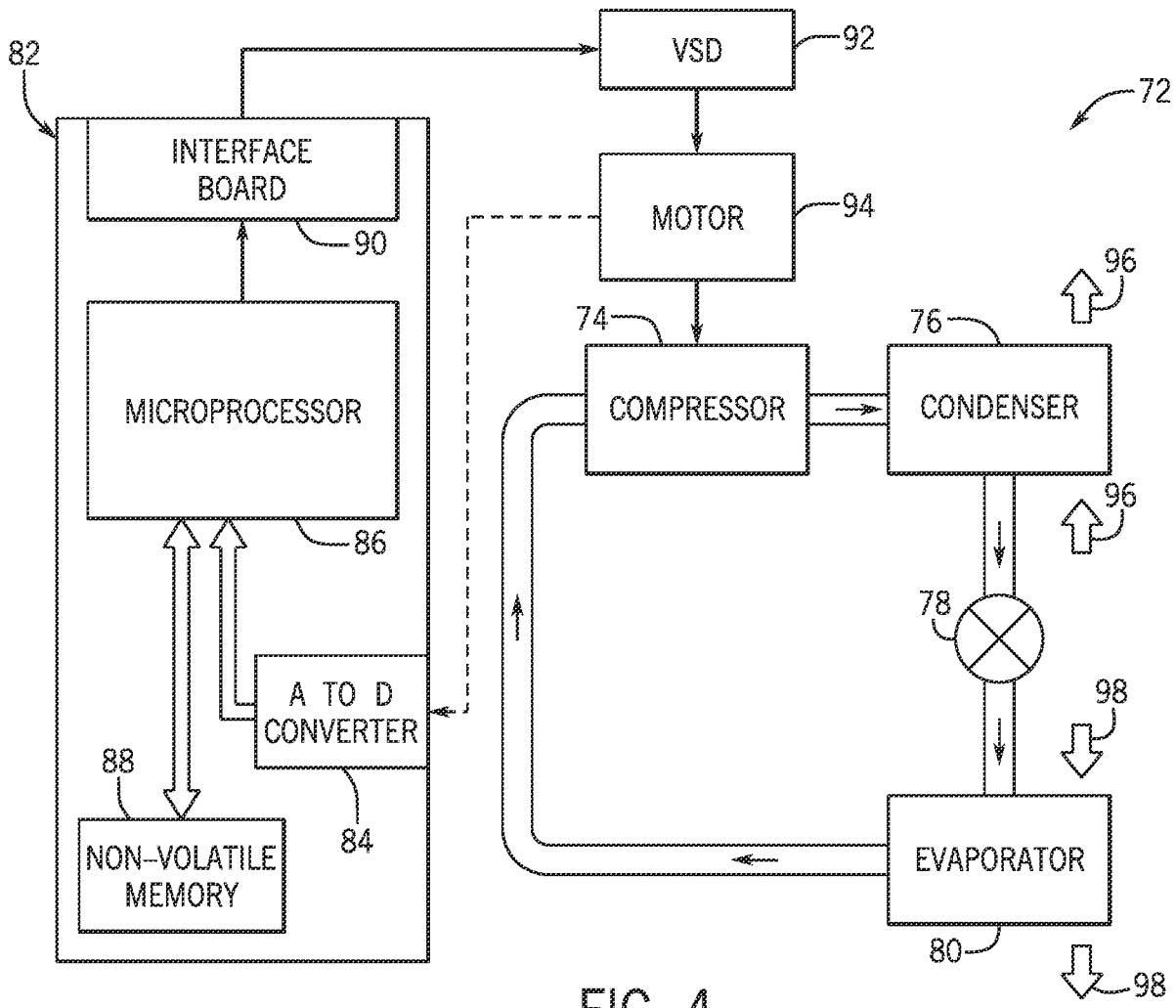
FIG. 4 is a schematic diagram of an embodiment of a vapor compression system that may be used in an HVAC unit, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, air handling units, or other heat pump or refrigeration applications.

The present disclosure is directed to a base pan assembly configured to be installed within an enclosure, housing, or support structure of an HVAC system. The base pan assembly includes a base pan that, in an installed configuration, may have a sloped profile that is configured to direct liquid out of the enclosure, thereby limiting accumulation of liquid within the enclosure that may otherwise collect on the base pan. For example, the base pan may have a downward slope extending from an interior of the enclosure to an outer edge of the enclosure. Thus, liquid entering and/or forming within the enclosure and collecting on the base pan may flow across the base pan and toward the outer edge to exit the enclosure. In some embodiments, the base pan may be configured to couple to another component within the enclosure. For instance, the base pan may be configured to couple to one or more base rails of the enclosure, thereby securing the base pan within the enclosure.

Additionally, the base pan assembly may be manufactured cost effectively, such as without the use of specialized tools or processes. For example, the base pan may be manufactured as a single piece or components having a generally flat or planar surface that does not include a sloped profile. During installation, the base pan assembly may be secured to the enclosure of the HVAC system to form a sloped profile of the base pan. For example, the base pan assembly may include fasteners (e.g., one or more nuts, bolts, etc.) configured to engage with the enclosure and secure the base pan to the enclosure in a sloped configuration. It should be noted that, although the present disclosure primarily discusses installation of the base pan assembly within an outdoor enclosure, such as for a condensing section of the HVAC system, the base pan assembly may be installed within any suitable enclosure or section of the HVAC system.

Figure 5:
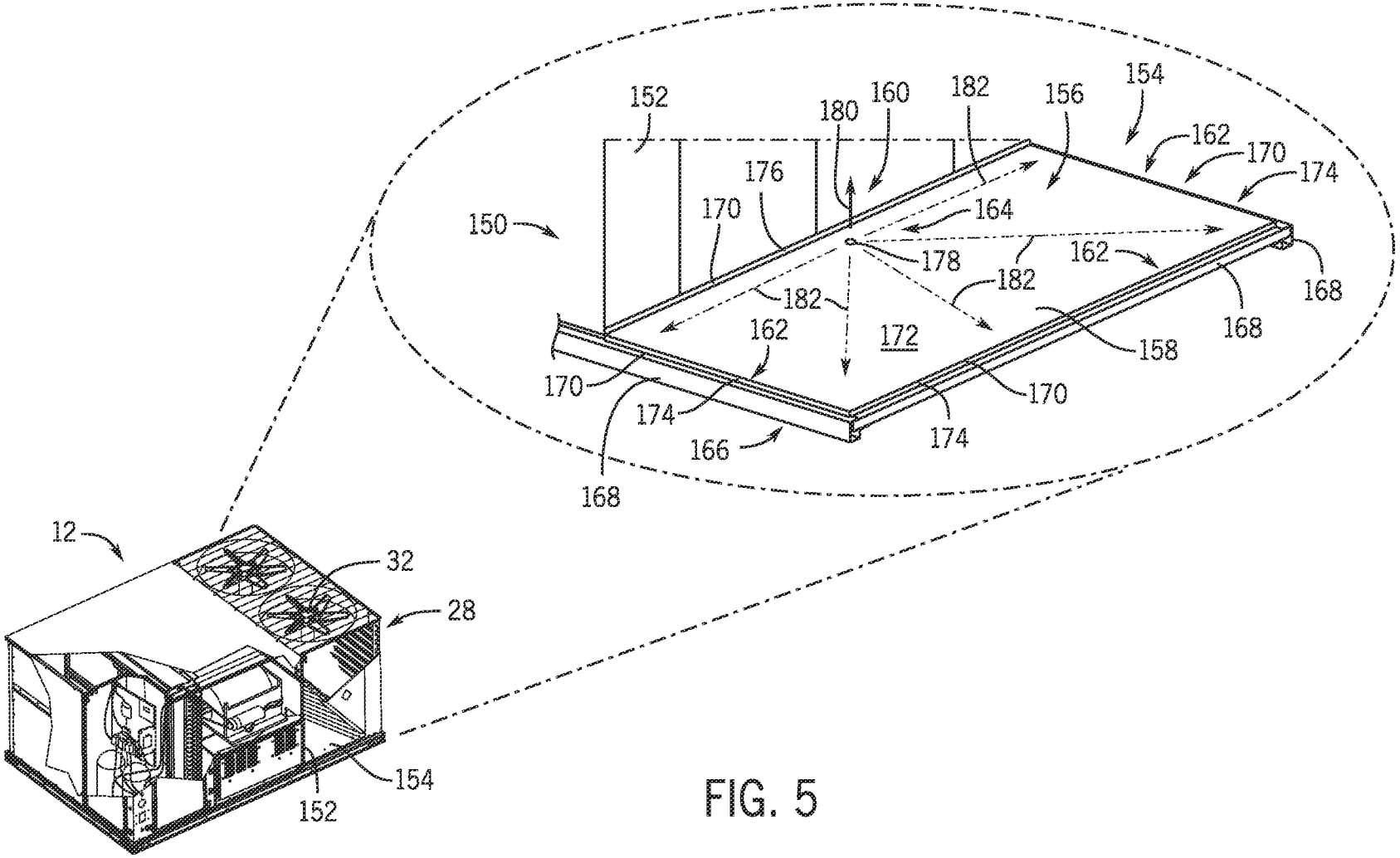
FIG. 5 is an expanded perspective view of an embodiment of a portion of an enclosure of an HVAC unit including a base pan assembly, in accordance with an aspect of the present disclosure.

FIG. 5 is an expanded perspective view of an embodiment of a portion of an enclosure 150, such as an HVAC unit enclosure, which may be configured to house, support, and/or enclose components of an HVAC system, such as the HVAC unit 12. For example, the enclosure 150 may contain and/or support the heat exchanger 28 of the HVAC unit 12 and the compressors 42 of the HVAC unit 12. However, the enclosure 150 may be used to enclose any suitable components of the HVAC unit 12 or other HVAC system (e.g., an air handler) in additional or alternative embodiments. As used herein, the enclosure 150 may or may not include side panels, partitions, and so forth, to generally contain a volume of space or a portion thereof. In the illustrated embodiment, certain components of the enclosure 150, such as the heat exchanger 28, the fans 32, and certain panels or partitions, have been removed for better visualization of an interior of the enclosure 150. The illustrated enclosure 150 includes a partition 152 (e.g., a wall, panels, an internal partition, etc.) that may separate a section 154 (e.g., a first section, a condenser section, a compressor section, an outdoor section, etc.) of the enclosure 150 from other sections of the enclosure 150. For example, the partition 152 may block air, liquid, and/or other elements (e.g., debris) from flowing between the section 154 and other sections of the enclosure 150. In this way, the section 154 of the enclosure 150 may generally be isolated from a remainder of the enclosure 150 (e.g., the HVAC unit 12). In some embodiments, the section 154 of the enclosure 150 may be an outdoor section of the HVAC unit 12 or a portion of the HVAC unit 12 positioned in an ambient environment. As a result, the section 154 of the enclosure 150 may be exposed to elements of the ambient environment, such as precipitation, that may cause liquid to enter the section 154 of the enclosure 150. However, it may be undesirable for liquid to accumulate within the enclosure 150 (e.g., the section 154).

For this reason, the enclosure 150 may include a base pan assembly 156 disposed within the section 154. The base pan assembly 156 includes a base pan 158 formed from a smooth material, such as sheet metal, and having a sloped configuration configured to direct a flow of liquid across the base pan 158. As mentioned above, in some embodiments, the section 154 of the enclosure 150 may contain a condenser and/or a compressor of the HVAC unit 12. For example, the condenser and/or compressor may be mounted onto a portion of the base pan 158 and/or may be positioned above the base pan 158. Thus, the base pan 158 may be a condenser and/or a compressor base pan. The section 154 may also include other components of the HVAC unit 12 disposed therein. In some embodiments, wires may extend through the section 154. For example, wires (e.g., power wires, communication wires, electrical wires, etc.) may extend from the compressor (e.g., from a motor of the compressor) within the section 154 to a control section or power section of the HVAC unit 12. Similarly, wires may extend from the condenser (e.g., from a condenser fan motor) to the control or power section of the HVAC unit 12 (e.g., through the partition 152). As will be appreciated, collection and/or prolonged accumulation of liquid within the section 154 having the compressor, condenser, and/or wires may be undesirable. The base pan assembly 156 disclosed herein enables cost effective and efficient drainage of liquid within the section 154 to mitigate wear, degradation, and/or performance reduction of the compressor, condenser, wires, and/or other components that may otherwise be caused by the collection or aggregation of liquid within the section 154.

In an installed configuration, the base pan 158 may be sloped from an inner portion 160 of the section 154 to an outer lateral edge 162 of the base pan 158 (e.g., of a main body of the base pan 158). The slope of the base pan 158 may direct a flow of liquid disposed on the base pan 158 within the section 154 toward the outer lateral edge 162. In the illustrated embodiment, the base pan 158 has a generally rectangular geometry and may be configured to direct the flow of liquid to the outer lateral edge 162 in various directions. In additional or alternative embodiments, the base pan 158 may have any other suitable geometry and may be configured to direct the flow of liquid to any suitable number of outer lateral edge 162.

In any case, the base pan 158 in the installed configuration with the enclosure 150 may have an elevated surface, portion, or section 164 (e.g., elevated relative to the outer lateral edge 162), which may be generally positioned at a center of the inner portion 160 of the section 154 of the enclosure 150. The base pan 158 may downwardly extend (e.g., relative to a direction of gravity) from the elevated surface 164 to the outer lateral edge 162. As such, the base pan 158 may be downwardly sloped from the inner portion 160 toward the outer lateral edge 162 in multiple directions. As a result, liquid disposed or collected on the base pan 158 may flow across the base pan 158 away from the elevated surface 164 and toward the outer lateral edge 162, where the liquid may exit the section 154 of the enclosure 150, such as by flowing over the outer lateral edge 162 and down a base 166 of the enclosure 150 to an external environment surrounding the enclosure 150. For example, the base 166 may be formed via base rails 168 (e.g., external base rails) coupled to one another and defining at least a portion of a perimeter of the enclosure 150 and/or HVAC unit 12. Thus, the base pan 158 may direct the liquid beyond (e.g., external to) the perimeter of the enclosure 150 and may limit or reduce accumulation of liquid within the section 154 of the enclosure 150.

In some embodiments, the base pan 158 (e.g., in the installed configuration) may have a substantially linear slope extending downwardly (e.g., relative to a direction of gravity) from the elevated surface 164. In other embodiments, the base pan 158 may have a variable slope, such as a curved slope, a step profile, or other slope generally extending downwardly from the elevated surface 164 in a continuous manner. That is, the base pan 158 in the installed configuration may not have portions that are raised relative to the elevated surface 164.

In an installed configuration, the base pan 158 may be secured to the base 166 of the enclosure 150 and/or to other portions of the enclosure 150. For example, the base pan 158 may include flanges 170 (e.g., peripheral flanges) that extend from a main body 172 (e.g., sloped surface, draining surface, etc.) of the base pan 158 and that may be secured to the enclosure 150. In particular, the flanges 170 include first flanges 174 (e.g., downward flanges, external flanges, outer edge flanges, etc.) extending downwardly (e.g., relative to gravity) from the main body 172 and configured to couple to (e.g., attach and/or secure to) the base rails 168 (e.g., exterior base rails) of the base 166. The flanges 170 may also include a second flange 176 (e.g., inner flange, interior flange, upward flange, etc.) extending upwardly (e.g., relative to gravity) from the main body 172 and configured to couple to (e.g., attach and/or secure to) the partition 152 of the enclosure 150. The flanges 170 may be secured to the enclosure 150 via mechanical fasteners or other suitable features or techniques.

To provide the sloped configuration of the base pan 158 in the installed configuration of the base pan assembly 156, the base pan assembly 156 includes an elevation system 178. As described in further detail below, the elevation system 178 includes one or more components configured to engage with the enclosure 150 and bias or position a portion of the base pan 158 (e.g., the main body 172) in an upward direction 180 (e.g., relative to gravity). For example, the elevation system 178 may include a fastener arrangement secured to the main body 172 and configured to engage with a component of the enclosure 150 (e.g., a cross rail) to bias or lift at least a portion of the main body 172 (e.g., a portion to which the fastener arrangement is secured) in the upward direction 180. In this way, the elevation system 178 may form or establish the elevated surface 164 and provide the sloped configuration of the base pan 158. Further, the elevation system 178 enables formation of the sloped configuration of the base pan 158 without utilization of specialized operations or tooling (e.g., hard tooling, a pressing machine, etc.). Indeed, the base pan 158 may be manufactured with the main body 172 as a generally planar or flat sheet (e.g., from sheet metal).

As will be appreciated, a location of the elevation system 178 relative to the main body 172 may be selected to provide a desired sloped configuration of the base pan 158. For example, in the illustrated embodiment, the location of the elevation system 178 provides a sloped configuration in which the main body 172 of the base pan 158 is downwardly sloped in directions 182. However, the elevation system 178 may be positioned in other locations along the main body 172 in other configurations. In any case, the sloped configuration of the base pan 158 enables flow of liquid accumulated on the main body 172 (e.g., flow in the directions 182) toward the outer lateral edge 162. In this way, liquid accumulated within the section 154 of the enclosure 150 may be drained therefrom and, for example, discharged to an environment external to the enclosure 150 (e.g., an ambient environment).

Figure 6:
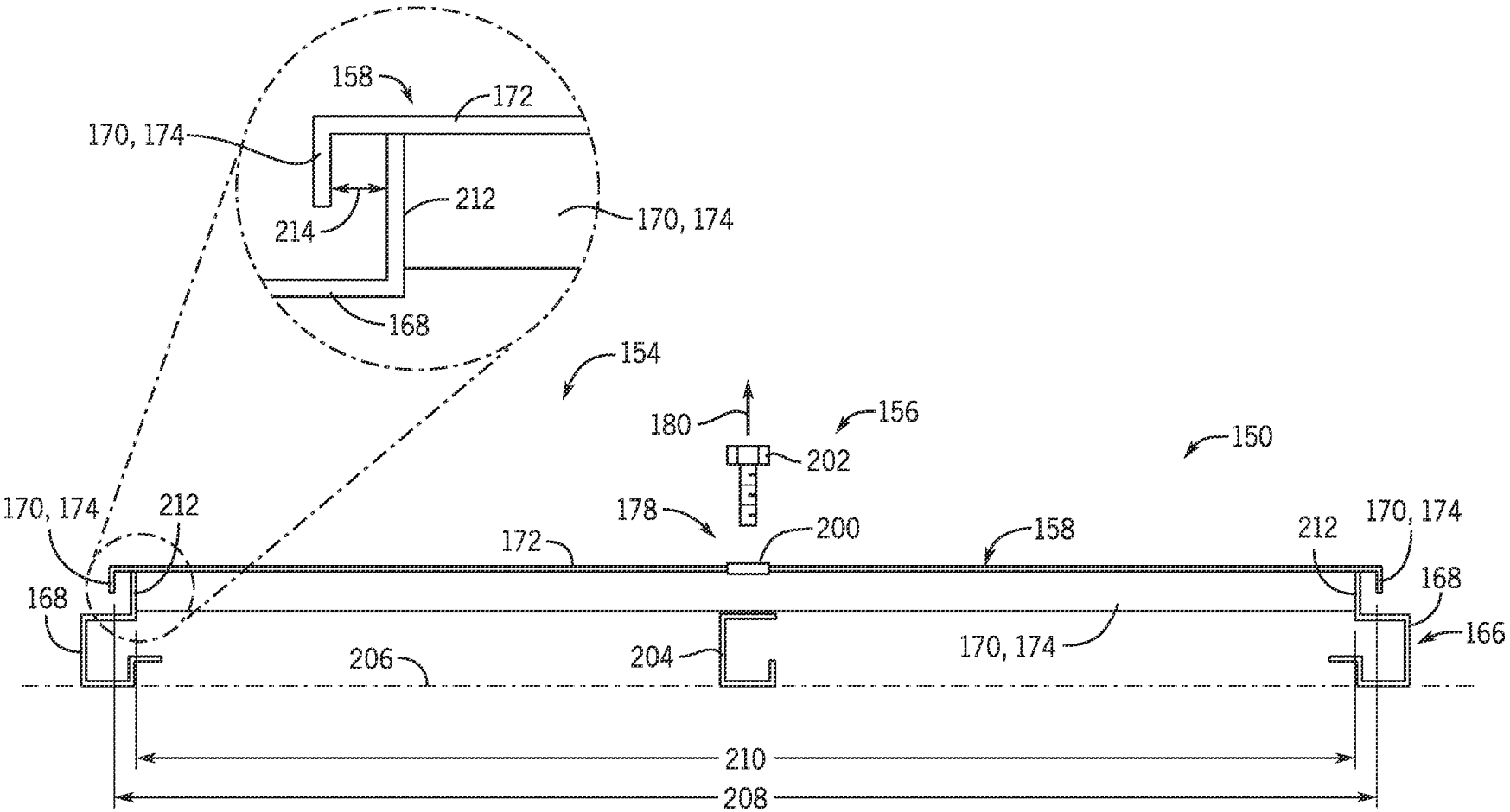
FIG. 6 is a cross-sectional side view of an embodiment of a base of an HVAC unit including a base pan assembly in a partially installed configuration, in accordance with an aspect of the present disclosure.

FIG. 6 is a cross-sectional side view of an embodiment of a portion of the enclosure 150, illustrating the base pan assembly 156 in an initial (e.g., intermediate, partially installed, flat) configuration. As shown, the base pan 158 is positioned within the section 154 and above the base 166 of the enclosure 150. Additionally, in the base pan 158 (e.g., the main body 172) is generally flat and is not sloped in the initial configuration. To provide the sloped configuration, the base pan assembly 156 includes the elevation system 178, which may include one or more mechanical fastener components, to bias at least a portion of the main body 172 of the base pan 158 in the upward direction 180. In the illustrated embodiment, the elevation system 178 includes an anchor 200 coupled to (e.g., secured) to the main body 172 of the base pan 158 and a fastener 202 in an uninstalled position. The anchor 200 may be a nut, rivet, grommet, or other suitable component (e.g., hardware component, fastener, etc.) configured to engage (e.g., mate) with the fastener 202, such as via respective threads of the anchor 200 and the fastener 202. Accordingly, the fastener 202 may be a bolt, screw, pin, rod, or the like. The fastener 202 may be installed to engage with the anchor 200 and with a rail 204 (e.g., a cross-rail, one of the base rails 168, an interior base rail, etc.) of the base 166 positioned beneath the base pan 158 (e.g., relative to a direction of gravity). In some embodiments, the rail 204 may be a hat channel, interior base rail, or cross-rail extending between base rails 168 (e.g., external base rails) of the base 166 (e.g., internal to a perimeter of the enclosure 150 defined by external base rails 158), and a component disposed within the section 154, such as a compressor, may be mounted to or supported by the rail 204. The rail 204 may extend between base rails 168 of the base 166, between one base rail 168 and the partition 152, or between any other suitable components of the base 166 and/or enclosure 150 in any desired or suitable direction. In the manner described further below, the engagement between the fastener 202, the anchor 200, and the rail 204 may drive or bias at least a portion of the main body 172 in the upward direction 180 to create the sloped arrangement of the base pan 158 in the installed configuration of the base pan assembly 156.

During installation of the base pan assembly 156, such as during actuation of the elevation system 178, the main body 172 of the base pan 158 is modified from the generally flat configuration illustrated in FIG. 6 to a sloped configuration, in which portions of the main body 172 are angled relative to horizontal (e.g., represented by line 206). Thus, an overall width 208 of the base pan 158 (e.g., a dimension extending between opposing first flanges 174) may be reduced during transition of the base pan 158 from the flat configuration to the sloped configuration. Accordingly, the base pan 158 may be manufactured such that the overall width 208 of the base pan 158 in the flat configuration is greater than a width 210 (e.g., a dimension) extending between respective mounting flanges 212 (e.g., mounting surface, mounting lips, etc.) of the opposing base rails 168 to which the base pan 158 is secured in the installed configuration. In other words, in the initial configuration illustrated in FIG. 6, a clearance 214 (e.g., a space, a gap, etc.) is provided between the mounting flange 212 and the first flange 174. In the installed configuration with the main body 172 in the sloped configuration, the overall width 208 of the base pan 158 may be reduced and may be substantially similar to the width 210 extending between the mounting flanges 212, such that corresponding mounting flanges 212 and first flanges 174 may be secured to one another. It should be appreciated that other dimensions of the base pan 158 may be selected to similarly facilitate installation of the base pan assembly 156 in the sloped configuration. For example, a dimension of the base pan 158 extending from the second flange 176 to the first flange 174 opposite the second flange 176 may be selected to be greater than a dimension of the enclosure 150 extending from the partition 152 to the base rail 168 opposite the partition 152 when the base pan 158 is in the flat configuration. When the base pan 158 is in the sloped configuration, such dimensions may be substantially similar to one another to facilitate securement of the second flange 176 to the partition 152 and securement of the corresponding first flange 174 to the mounting flange 212 of the base rail 168 opposite the partition 152. Indeed, the base pan 158 may be manufactured to provide the clearance 214 at any desired peripheral edge (e.g., first flanges 174, second flange 176) when the base pan 158 is in the flat configuration.

Figure 7:
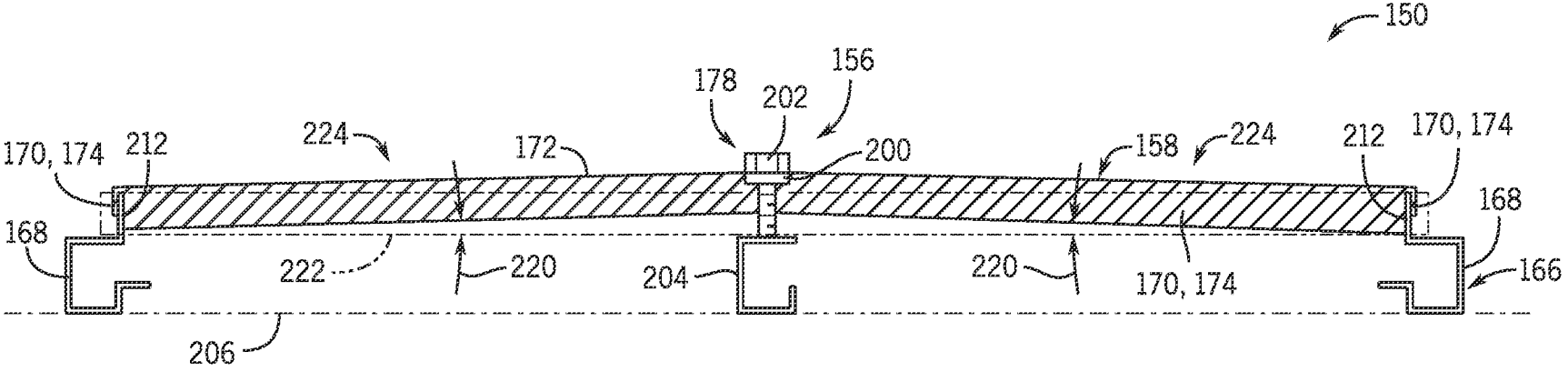
FIG. 7 is a cross-sectional side view of an embodiment of a base of an HVAC unit including a base pan assembly in an installed configuration, in accordance with an aspect of the present disclosure.

FIG. 7 is a cross-sectional side view of an embodiment of a portion of the enclosure 150, illustrating the base pan assembly 156 in the installed configuration whereby the base pan 158 is in the sloped configuration. That is, one or more portions of the main body 172 of the base pan 158 are disposed at an angle 220 relative to horizontal 206 and relative to the flat configuration of the main body 172, represented by phantom lines 222. As described further below, the fastener 202 engages with the anchor 200 and the rail 204 to bias at least a portion of the main body 172 upward. In the illustrated embodiment, the elevation system 178 and the rail 204 are generally positioned at a midpoint of the width 208 and the width 210, respectively. Thus, portions 224 of the base pan 158 (e.g., of the main body 172) are disposed at angles 220 that are substantially similar to one another. However, in other embodiments, the elevation system 178 and the rail 204 may be positioned in other locations relative to the widths 208 and 210, relative to the base pan 158, relative to the enclosure 150, relative to the partition 152, and so forth. In this way, the various portions 224 of the base pan 158 may be disposed at respective angles 220 (e.g., different angles 220), as desired.

Figure 8:
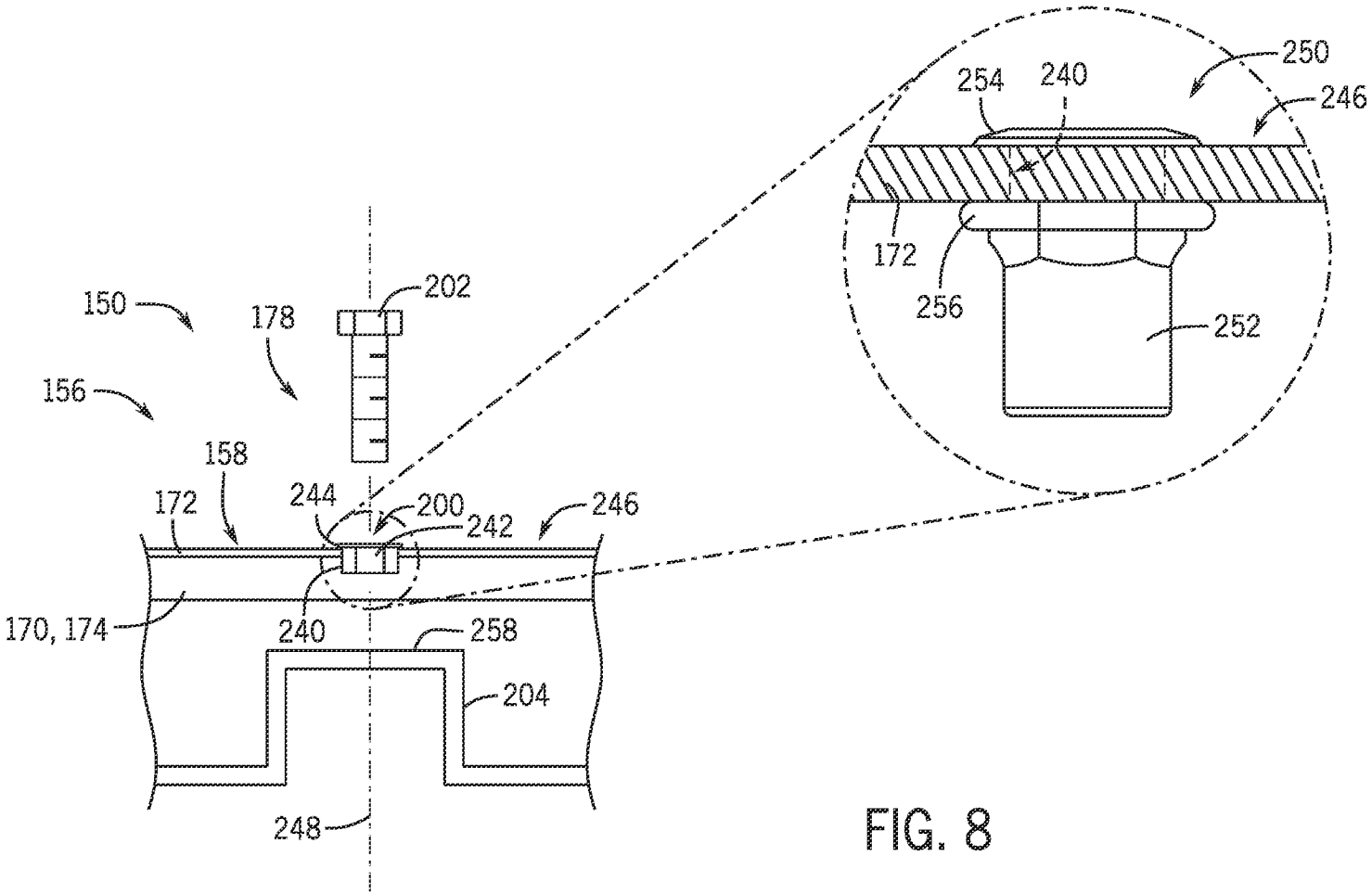
FIG. 8 is a partial cross-sectional side view of an embodiment of a base of an HVAC unit, illustrating installation of a base pan assembly, in accordance with an aspect of the present disclosure.
Figure 9:
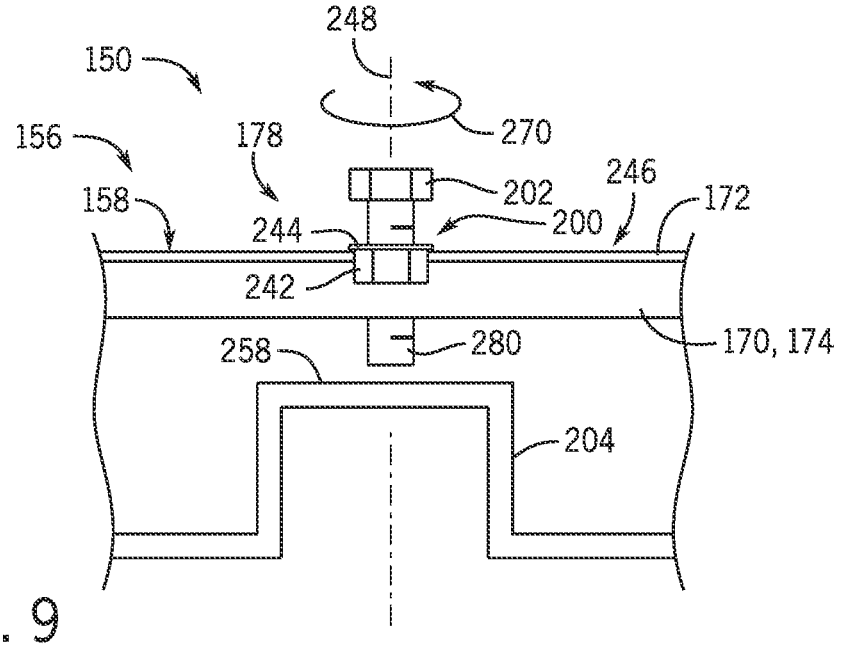
FIG. 9 is a partial cross-sectional side view of an embodiment of a base of an HVAC unit, illustrating installation of a base pan assembly, in accordance with an aspect of the present disclosure.
Figure 10:
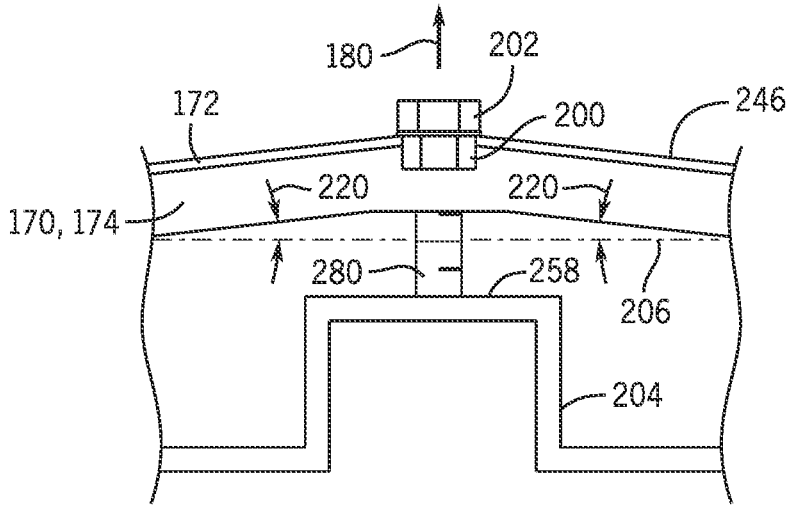
FIG. 10 is a partial cross-sectional side view of an embodiment of a base of an HVAC unit, illustrating installation of a base pan assembly, in accordance with an aspect of the present disclosure.

FIGS. 8-10 are partial cross-sectional side views of an embodiment of the enclosure 150, illustrating actuation of the elevation system 178 during installation of the base pan assembly 156 with the enclosure 150. As shown in FIG. 8, the base pan 158 is initially positioned above (e.g., relative to gravity) the rail 204 (e.g., hat channel) within the section 154 of the enclosure 150. The anchor 200 of the elevation system 178 is secured to the base pan 158 (e.g., installed with the base pan 158), and the fastener 202 is disengaged (e.g., uninstalled) from the anchor 200 and other components of the base pan assembly 156 and enclosure 150. As mentioned above, the anchor 200 may be any suitable component configured to be fixedly attached or secured to the base pan 158, such as a nut, rivet, grommet, another threaded insert, or the like, and configured to engage with the fastener 202.

The anchor 200 may be secured (e.g., fixedly attached) to the base pan 158 using any suitable features or techniques. For example, the anchor 200 may be a nut having internal threads, and at least a portion of the anchor 200 may extend into an aperture 240 (e.g., an opening, a hole, etc.) formed in the main body 172 of the base pan 158. In some embodiments, the aperture 240 may have a geometry or profile (e.g., a first profile) corresponding to (e.g., matching) an outer geometry or profile (e.g., a second profile) of a body 242 of the anchor 200. For example, the corresponding geometries may be square, rectangular, circular, hexagonal, octagonal, another polygonal geometry, or another other suitable shape. Thus, the aperture 240 may accommodate the anchor 200 and/or block movement (e.g., rotational movement) of the anchor 200 relative to the main body 172. The anchor 200 may additionally or alternatively include a flange (e.g., an upper flange) 244 extending from the body 242 and configured to abut a top surface 246 of the main body 172 in an installed configuration of the anchor 200 to at least partially block movement of the anchor 200 relative to the main body 172 along an axis 248 of the anchor 200. In some embodiments, the anchor 200 may be secured to the base pan 158 via an interference fit and/or a friction fit. The anchor 200 may additionally or alternatively be secured to the base pan 158 via welding, brazing, or other suitable fabrication or joining process.

In some embodiments, the anchor 200 may be a rivet nut 250. As will be appreciated, the rivet nut 250 may capture the main body 172 of the base pan 158 in an installed configuration of the rivet nut 250. For example, a body 252 (e.g., sleeve) of the rivet nut 250 may be inserted into the aperture 240 of the main body 172 until a collar 254 of the rivet nut 250 is in abutment with the top surface 246 of the main body 172. Thereafter, the fastener 202 or other suitable tool may be inserted into rivet nut 250, such that corresponding threads of the fastener 202 and the rivet nut 250 engage with one another. In this way, a protrusion or bulge 256 may be formed in the body 252 beneath the main body 172 of the base pan 158, such that the collar 254 and the protrusion 256 capture the main body 172 of the base pan 158 therebetween and secure the rivet nut 250 to the base pan 158.

In any case, the anchor 200 is secured to the base pan 158 such that the anchor 200 is positioned above the rail 204 (e.g., relative to gravity) along the axis 248. In this way, the anchor 200 is positioned to enable engagement of the fastener 202 with an upper surface 258 of the rail 204 during installation of the base pan assembly 156.

FIG. 9 illustrates installation of the fastener 202 via engagement with the anchor 200. For example, the fastener 202 may be a bolt having external threads configured to engage with corresponding internal threads of the anchor 200. As the fastener 202 is rotated in direction 270 (e.g., about the axis 248) the fastener 202 is translated along the axis 248 toward the upper surface 258 of the rail 204. The rotation of the fastener 202 will cause a distal end 280 (e.g., axial end) of the fastener 202 to contact the upper surface 258 of the rail 204, as shown in FIG. 10. With the distal end 280 of the fastener 202 engaged with the upper surface 258 of the rail 204 and the anchor 200 fixed to the base pan 158, further actuation (e.g., rotation in the direction 270) of the fastener 202 will force the base pan 158 in the upward direction 180. That is, the threaded engagement between the fastener 202 and the anchor 200 will urge or bias the base pan 158 in the upward direction 180 as the fastener 202 is rotated while engaged with the upper surface 258 of the rail 204. In this way, the base pan 158 may be raised (e.g., relative to the base 166) to provide the elevated surface 164 at and around the position of the elevation system 178 and establish the sloped configuration of the base pan 158.

In accordance with present techniques, the base pan assembly 156 may be installed within the enclosure 150 in any of various sequences (e.g., sequences of steps). That is, the various steps associated with installation of the base pan assembly 156 to provide the sloped configuration of the base pan 158 may completed in different orders. For example, the base 166 of the enclosure 150 (e.g., the base rails 168 and the rail 204) and the partition 152 may be assembled first. Thereafter, the base pan 158 may be positioned within the section 154 of the enclosure 150, and the elevation system 178 may be installed with the base pan 158. That is, the elevation system 178 may be secured to the base pan 158 and actuated to engage with the rail 204 and raise the base pan 158 in the upward direction 180.

Figure 11:
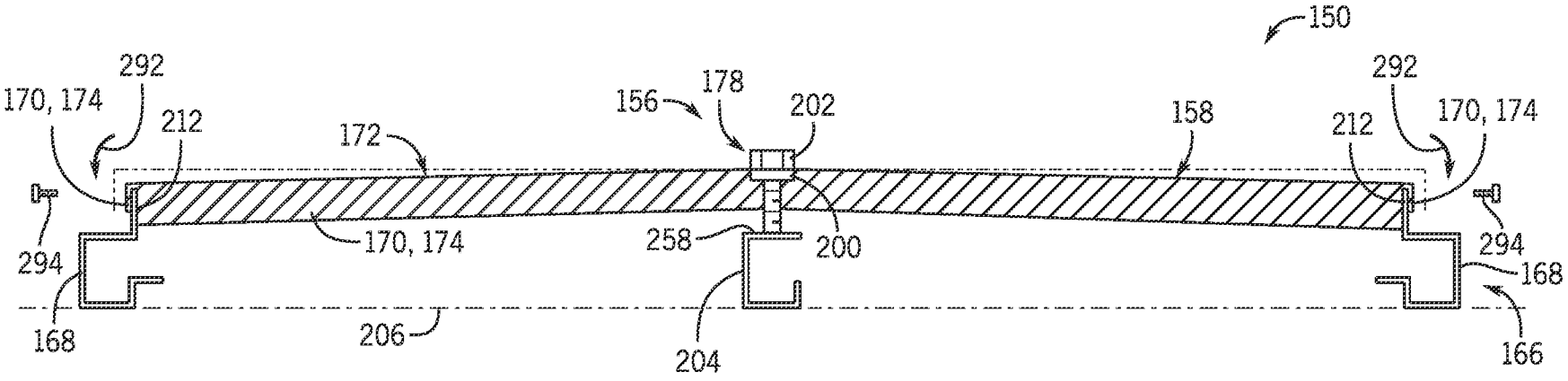
FIG. 11 is a cross-sectional side view of an embodiment of a base of an HVAC unit, illustrating installation of a base pan assembly, in accordance with an aspect of the present disclosure.

With the base pan 158 raised via engagement between the fastener 202 and the upper surface 258 of the rail 204, the base pan 158 is transitioned from the flat configuration to the sloped configuration (e.g., the installed confirmation). For example, FIG. 11 is a cross-sectional side view of an embodiment of a portion of the enclosure 150, illustrating an installed configuration of the elevation system 178 and transition of the base pan 158 from the flat configuration to the sloped configuration. Once the base pan 158 is raised from the base 166 via engagement between the fastener 202 and the rail 204, as represented by phantom lines 290, the flanges 170 may be transitioned (e.g., rotated, pivoted, biased, pressed, etc.), as indicated by arrows 292, in a generally downward direction. In this way, the flanges 170 may be positioned to abut the mounting surfaces 212 of the base rails 168 and/or abut a base of the partition 152 to enable securement of the flanges 170 to the base rails 168 or partition 152. As mentioned above, the flanges 170 may be secured to the base rails 168 and/or the partition 152 via mechanical fasteners 294. The transition of the flanges 170 also provides the sloped configuration of the base pan 158. That is, the main body 172 of the base pan 158 is biased to slope downwardly at the angle 220 relative to horizontal 206. However, in other embodiments, the base pan assembly 156 may be installed utilizing a different sequence of steps. For example, the flanges 170 may be secured to the base rails 168 and the partition 152, and the elevation system 178 may subsequently be installed and actuated to raise the base pan 158 and established the sloped configuration.

The angle 220 of slope may be adjusted via further actuation of the fastener 202 (e.g., actuation of the elevation system 178). For example, the fastener 202 may be rotated in the direction 270 or in a direction opposite the direction 270 to adjust an amount by which the elevated surface 164 is raised from the upper surface 258 of the rail 204. In this way, a desired magnitude of the angles 220 may be achieved. It should be appreciated that the slope of the main body 172 of the base pan 158 may be proportional (e.g., directly proportional) to the actuation (e.g., rotation) of the fastener 202 when the fastener 202 is engaged with the rail 204 and the flanges 170 are secured to the enclosure 150.

In accordance with present techniques, liquid accumulated on a base pan within a section of an enclosure of an HVAC system may be discharged or drained from the HVAC unit in a cost effective and efficient manner. As discussed above, a base pan assembly includes a base pan that may be cost effectively manufactured without utilization of specialized processes or tools to have a generally flat configuration. The base pan assembly further includes an elevation system configured to transition the base pan assembly from the flat configuration to a sloped configuration during installation of the base pan assembly with the enclosure of the HVAC unit. The elevation system includes one or more mechanical fastener components that may be efficiently implemented in a cost-effective manner to provide the sloped configuration and enable simplified adjustment of the sloped configuration.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and air conditioning (HVAC) system, comprising:

a base pan assembly coupled to a base of an enclosure of the HVAC system, wherein the base pan assembly comprises:

a base pan comprising a main body having a first slope extending from an inner portion of the main body to a first outer edge of the main body and having a second slope extending from the inner portion to a second outer edge of the main body, wherein the first slope is configured to direct condensate to the first outer edge and the second slope is configured to direct condensate to the second outer edge; and an elevation system coupled to the inner portion of the main body of the base pan, wherein the elevation system is actuatable to engage with the base of the enclosure and adjust the first slope and the second slope of the main body.

2. The HVAC system of claim 1, wherein the elevation system comprises an anchor coupled to the main body and a fastener engaged with and extending through the anchor.

3. The HVAC system of claim 2, wherein the base pan comprises an aperture, and the anchor extends through the aperture.

4. The HVAC system of claim 3, wherein the anchor comprises a nut, the aperture comprises a first profile, the nut comprises a second profile, and the first profile and the second profile correspond with one another.

5. The HVAC system of claim 3, wherein the anchor comprises a rivet nut, and the rivet nut captures the main body of the base pan between a collar of the rivet nut and a protrusion of the rivet nut.

6. The HVAC system of claim 2, wherein the fastener is configured to engage with a rail of the base to bias the base pan away from the base and provide the first slope and the second slope.

7. The HVAC system of claim 6, wherein the fastener is configured to rotate relative to the anchor and the base pan to adjust the first slope and the second slope.

8. The HVAC system of claim 6, wherein the fastener comprises a bolt, and the bolt and the anchor are in threaded engagement with one another.

9. The HVAC system of claim 1, wherein the base pan comprises a plurality of flanges extending from the main body, wherein each flange of the plurality of flanges is secured to at least one base rail of a plurality of base rails of the base or to an internal partition of the enclosure.

10. A heating, ventilation, and air conditioning (HVAC) system, comprising:

an enclosure configured to support and contain at least one component of a vapor compression system, wherein the enclosure comprises a base;

a base pan coupled to the base, wherein the base pan comprises a main body extending along a first slope from an inner portion of the main body to a first outer edge of the main body and extending along a second slope from the inner portion to a second outer edge of the main body, wherein the first slope is configured to direct condensate to the first outer edge and the second slope is configured to direct condensate to the second outer edge; and an elevation system coupled to the inner portion of the main body of the base pan, wherein the elevation system is configured to engage with the base, and the elevation system is actuatable to engage with the base to adjust the first slope and the second slope.

11. The HVAC system of claim 10, wherein the base comprises a plurality of base rails coupled to one another, and the first outer edge and the second outer edge of the main body are coupled to the plurality of base rails.

12. The HVAC system of claim 11, wherein the base comprises a cross-rail extending between at least two base rails of the plurality of base rails, the cross-rail is configured to support the at least one component, and the elevation system is configured to engage with the cross-rail.

13. The HVAC system of claim 12, comprising the at least one component, wherein the at least one component comprises a compressor, a heat exchanger, or both.

14. The HVAC system of claim 10, wherein the elevation system comprises an anchor secured to the main body and a fastener configured to extend through the anchor and engage with the base.

15. The HVAC system of claim 14, wherein the anchor comprises a rivet nut.

16. The HVAC system of claim 14, wherein the fastener is configured to bias the main body away from the base to transition the main body from a flat configuration to a sloped configuration.

17. A heating, ventilation, and air conditioning (HVAC) unit, comprising:

an enclosure comprising a base;

a compressor disposed internal to the enclosure and supported by the base;

a base pan disposed within the enclosure beneath the compressor, relative to gravity, and coupled to the base;

an anchor coupled to the base pan; and a fastener extending through the anchor, wherein rotation of the fastener is configured to cause the fastener to engage with the base and bias the base pan away from the base such that the base pan comprises a slope extending from the anchor to an outer edge of the base pan.

18. The HVAC unit of claim 17, wherein the base comprises:

a plurality of external base rails coupled to one another and defining at least a portion of a perimeter of the HVAC unit; and an internal base rail extending from at least one external base rail of the plurality of external base rails, wherein the internal base rail is disposed within the perimeter of the HVAC unit, wherein the fastener is configured to engage with the internal base rail.

19. The HVAC unit of claim 18, wherein the fastener is adjustable relative to the anchor to adjust the slope.

20. The HVAC unit of claim 19, wherein the anchor comprises a nut, the fastener comprises a bolt, and the bolt is configured to rotate relative to the nut to adjust the slope.

* * * * *